United States Patent [19]

Apfelbacher et al.

[11] Patent Number: 4,883,927

[45] Date of Patent: Nov. 28, 1989

[54] LOCKING ARRANGEMENT FOR TWO SWITCHGEARS

[75] Inventors: Walter Apfelbacher, Freihung; Edgar Wiessner, Amberg; Karl-Hans Bärnklau, Weiden, all of Fed. Rep. of Germany

[73] Assignee: Siemens Aktiengesellschaft, Munich, Fed. Rep. of Germany

[21] Appl. No.: 264,200

[22] Filed: Oct. 28, 1988

[30] Foreign Application Priority Data

Oct. 30, 1987 [DE] Fed. Rep. of Germany ... 8714499[U]

[51] Int. Cl.[4] ..... H01H 9/20

[52] U.S. Cl. ..... 200/50 C; 335/161

[58] Field of Search ..... 200/50 R, 50 C; 361/343; 335/159, 160, 161

[56] References Cited

U.S. PATENT DOCUMENTS 3,149,210 9/1964 Haydu et al. ..... 200/50 C 4,356,363 10/1982 Harbauer et al. ..... 200/50 C

FOREIGN PATENT DOCUMENTS 1902103 10/1964 Fed. Rep. of Germany .

2473218 7/1981 France .

OTHER PUBLICATIONS

European Search Report No. RS 80683 DE; 10-1-5-1988.

Siemens, Siemens List NS2; p. 4/69; date: 1987.

*Primary Examiner*—J. R. Scott

*Attorney, Agent, or Firm*—Kenyon & Kenyon

[57] ABSTRACT

The contactors for a pair of switchgears are coupled via a blocking body in such a way that upon activation of one switchgear the other switchgear, which acts upon the blocking body in a sense opposite to that of the first switchgear is blcoked in its activation motion. To this end, each slide that is guided in a guide housing is rigidly connected with a tappet in the direction of motion via the collar of a collar screw which screwed into the slide. Each of the lobes of the heart-shaped blocking body are essentially rigidly connected with one of the tappets via dogs in the direction of motion.

7 Claims, 5 Drawing Sheets

LOCKING ARRANGEMENT FOR TWO SWITCHGEARS

BACKGROUND OF THE INVENTION

1. Field of the Invention

The present invention relates to a locking arrangement for two switchgears. More particularly, the present invention relates to a locking arrangement in which a blocking body couples the switchgears in such a way that upon activation of a first one of the switchgears, the other switchgear, which acts upon the blocking body in an opposite sense as compared to that of the first switchgear, is blocked in its activation motion.

2. Related Art

In a known locking arrangement disclosed in West German Utility Patent No. 19 02 103, a guide housing is screwed to the mounting plate With a U-shaped strap. The switchgears, contactors, are provided with two-armed levers which are connected pivotally with the activation means of the contactor at a point between a support point on the contactor housing and a connection with tappets guided in the guide housing. Adjusting screws are provided at the ends of the levers connected to the tappets. These screws can be secured with a locking nut. The heart-shaped blocking body is suspended on a spring in the guide housing. Due to the presence of the spring, however, it is not possible to exclude all of the play that arises in the movement of lobes of the blocking body and connected tappets so that relatively large paths must be accepted for the tappets. By providing levers with some degree of complexity these large paths are taken into account.

A simple connection of slides in the locking arrangement with the activation means can be achieved if the slides are positively coupled via projections which engage the activation means of the switchgears.

Such coupling is already known from the Siemens List NS2, 1987, page 4/69. In this configuration projections of the locking element are brought out through the auxiliary switch window. In addition, the locking element here is height-adjustable together with the guide housing for the purpose of which longer screws are provided.

SUMMARY OF THE INVENTION

The present invention is, thus, based on the task of creating a locking arrangement for switch-gear which is widely applicable having a simple structure without lever transmission and a simplified method of adjustment.

This is achieved simply in that an adjusting means consisting of a pair of collar screws where each screw is connected to a slide in the guide housing and to a tappet associated with a lobe of a heart shaped blocking body. The collar screw is screwed into slides guided in the guide housing. The collar of each screw is rigidly connected with the associated tappet in the direction of motion. The lobes of the heart are essentially rigidly connected with the tappets in the direction of motion via dogs.

It is further advantageous if length-adjustable feet are arranged on the guide housing. A simple attachment of the feet is possible if these feet including teething, before being fastened on the mounting plate, can be swung into a toothing strip of the guide housing. If the feet include a C-shaped part that can encompass trapezoidal parts formed onto a two-part guide housing, then means for connecting the housing parts can be omitted. A height adjustment with respect to different contactors can be achieved simply in this second configuration for the feet are formed at the bottom of the C-shaped part and the trapezoidal parts formed on the surface of the guide housing are provided with lock-in toothing corresponding to the teeth and toothing strip, on a surface pointing away from the housing. Projections engaging the activation means of the switchgears, given the corresponding setting of the housing feet, determine the position of the slides in the guide housing and, hence the distance of the blocking body, which is heart-shaped, from a blocking curve. This distance can be adjusted to a preset dimension without special measuring procedures if the collar screws are of such length that the surfaces of their respective heads at the given position of the blocking body are flush with the surface of the guide housing.

A simple coupling between tappet and blocking body which is effective in both directions of motion can be achieved if the dogs are H-shaped and are disposed into fitted recesses in the tappet and the blocking body transverse to the direction of motion.

DETAILED DESCRIPTION

Figure 1:
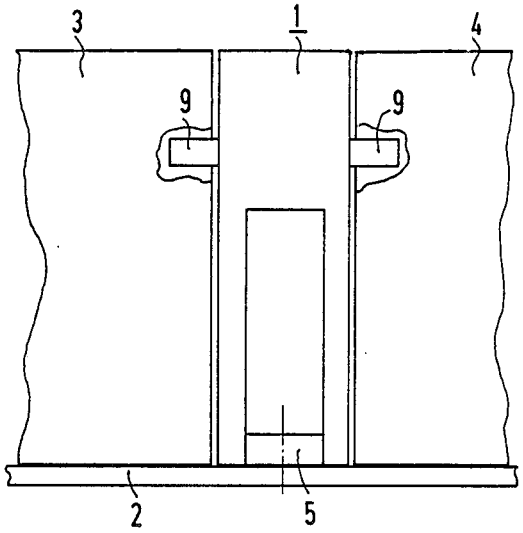
FIG. 1 illustrates a lateral view of a locking arrangement according to an embodiment of the present invention disposed on a mounting plate between two contactors.
Figure 2:
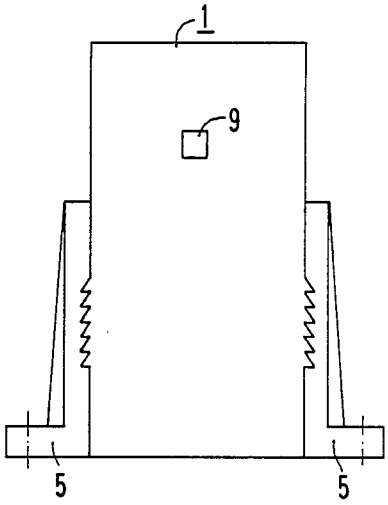
FIG. 2 illustrates a lateral view of the locking arrangement of the embodiment of FIG. 1 in an unmounted state.
Figure 3:
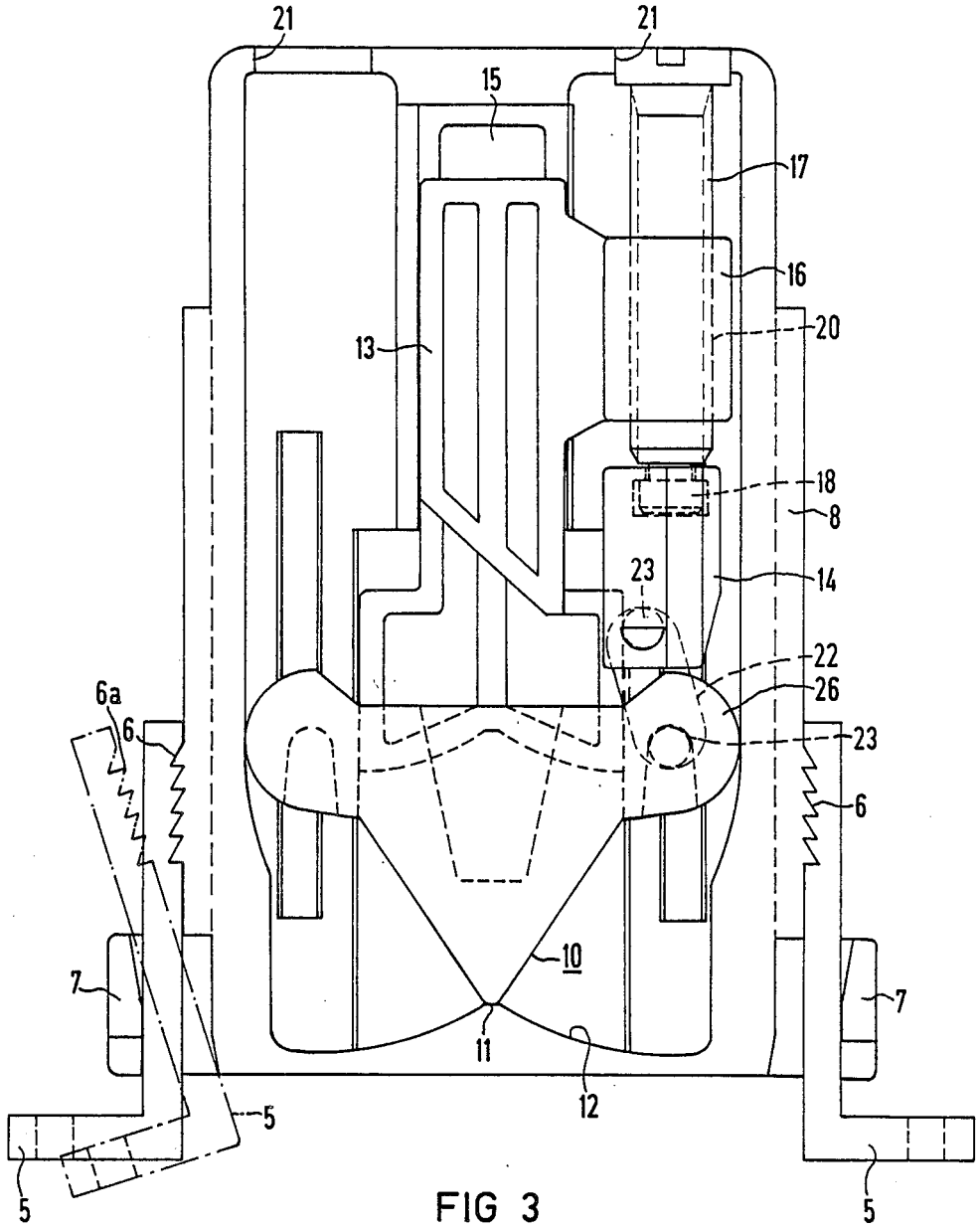
FIG. 3 illustrates the locking arrangement of the embodiment of FIG. 1 with an open guide housing including an inserted locking body and a unilaterally connected tappet and slide.
Figure 4:
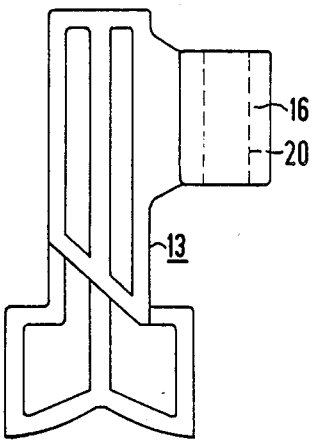
FIGS. 4, 5 and 6 illustrate a front view top view and side view respectively of the slide of FIG. 3.
Figure 6:
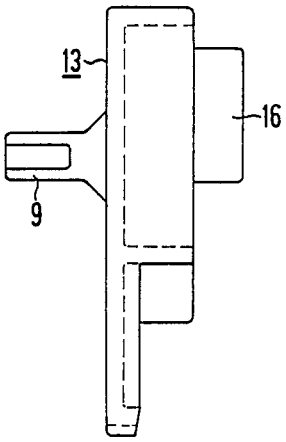
Figure 5:
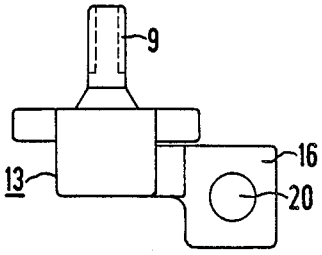
Figure 7:
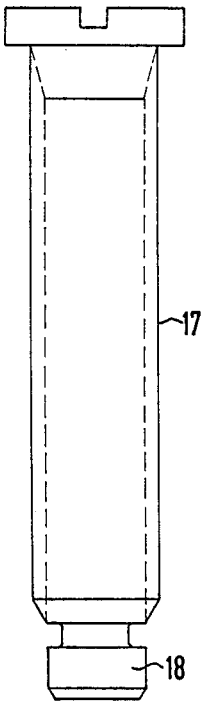
FIG. 7 illustrates a collar screw for connecting the slide and tappet of FIG. 3.

As can be seen from Fig. 1 a locking arrangement 1 is fastened on a mounting plate 2 between two contactors 3 and 4. For mounting purposes feet 5 are provided on the locking arrangement 1. As is shown in FIG. 3 the feet 5 can be swung into a toothing strip 6 before assembly. A pre-set position is indicated by dashed lines in FIG. 3. In the pre-set position the feet 5 are positioned such that teeth 6*a* of feet 5 are disengaged from the tooth strip 6. After being swung into a set position wherein teeth 6*a* engage with toothing strip 6 the feet 5 brace themselves against straps 7 of the guide housing 8 of the locking arrangement 1 and are subsequently screwed to the mounting plate 2 with fastening screws. The length of feet 5 determined by the positioning of teeth 6*a* with respect to toothing strip 6 determines the point of attack of projection 9 which engages an activation element (not shown in detail) for one of the contactors 3 and 4. Each contactor has an associated activation element. Similarly each activation element has an associated projection 9.

Figure 18:
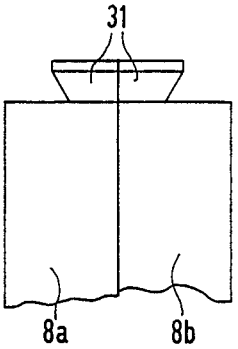
FIG. 18 illustrates a partial view of parts of the guide housing placed adjacent to each other with corresponding tooth strips formed on these parts.
Figure 19:
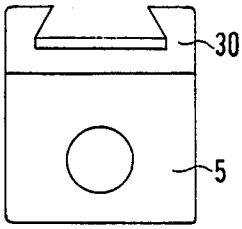
FIG. 19 illustrates a top view onto a model of an alternate embodiment of a foot with C-shaped part to be used with a guide housing of FIG. 18 in a locking arrangement as illustrated in FIG. 3.
Figure 17:
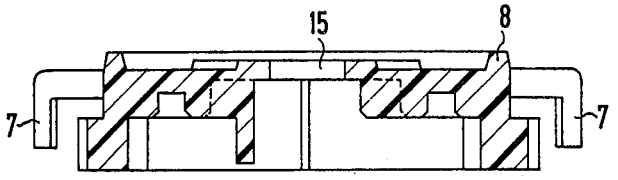
FIG. 17 illustrates a cross sectional representation of the part of the guide housing of FIG. 16 taken along line XVII—XVII.

The feet 5 can also have a C-shaped part 30 as shown in FIG. 19 for providing a coupling to the guide housing 8 of the locking arrangement. The guide housing 8 may be constructed of two guide housing parts 8*a* and 8*b* disposed adjacent to one another. This C-shaped part 30 of feet 5 of Fig. 19 can connect trapezoidal parts 31 formed on the two guide housing parts 8*a* and 8*b* disposed adjacent to each other as is shown in FIG. 18. The trapezoidal parts 31 can be built to include toothing (not shown) on the side facing away from the guide housing parts 8*a* and 8*b* as a toothing strip which cooperates with additional locking devices provided at the bottom of the C-shaped part 30 (also not shown) in a manner similar to that of the toothing strip 6 and teeth 6*a* of FIG. 3.

In the interior of the guide housing 8 a heart-shaped blocking body 10 is guided with a tip 11 of the heart disposed on a blocking curve 12 in the guide housing 8. Furthermore, two slides 13 and two tappets 14, one slide and one tappet associated with each lobe of heart-shaped blocking body 10 are displaceably supported in the guide housing 8. Each of the projections 9 is associated with one of the slides 13 and each projection is disposed through a guide slit 15 in one half of the guide housing 8, either guide housing part 8*a* or guide housing part 8*b* where each guide housing part is associated with one of the slides 13. A lateral portion 16 formed on slide 13 functions to couple the slide 13 to the particular tappet 14 associated with that slide 13. A collar screw 17 actually connects the lateral portion 16 of slide 13 with tappet 14. A collar 18 of the collar screw 17 is slid into a laterally open, hammer head-shaped recess 24 of tappet 14 after it has been screwed as self-cutting screw into hole 20 of the lateral portion 16. By rotating collar screw 17, which even in the built-in state of the locking arrangement 1 is accessible by way of activation holes 21 in the guide housing 8, precise adjustment of extensions 9 with respect to the activation mechanisms of contactors 3 and 4 can be carried out independently of each other. The slides 13 are located mirror-image like above one another so that on both sides of the guide housing 8 the projections 9 project from the guide slits 15.

Figure 14:
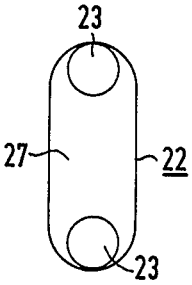
FIGS. 14 and 15 illustrate front and side view onto an H-shaped dog of the locking arrangement of FIG. 3.
Figure 15:
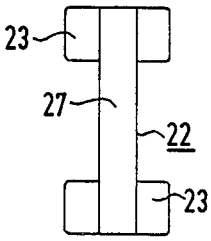
Figure 16:
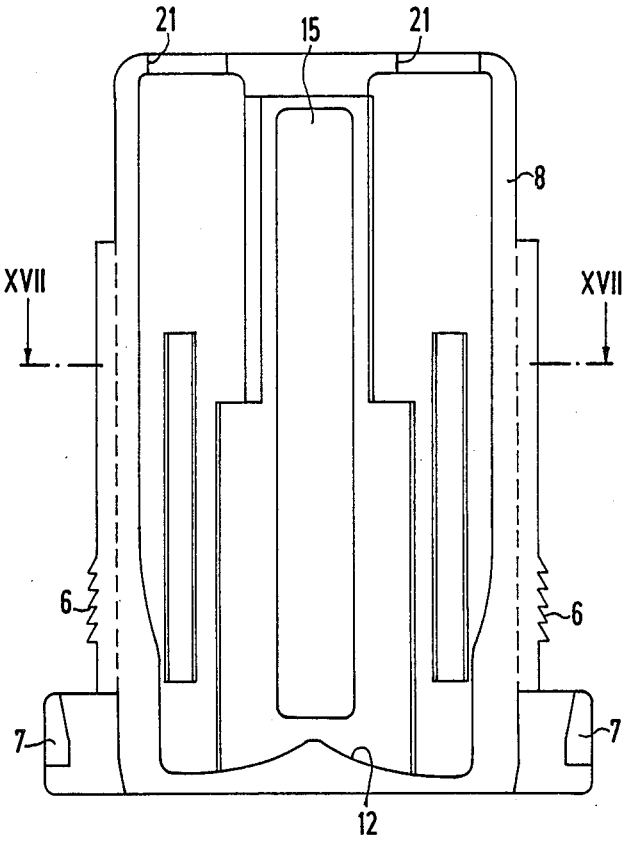
FIG. 16 illustrates a side view of the inside of one part of the guide housing of the locking arrangement of FIG. 3.

In order to also achieve direct coupling of a tappet 14 to a respective lobe of the heart-shaped blocking body 10, an H-shaped dog 22 is provided. Such an H-shaped dog 22 is shown in front and side view in FIGS. 14 and 15 respectively. One of the arms 23 of the H-shaped dog 22 is slid into a hammer head-shaped recess 24 in tappet 14 that is transverse to the direction of activation as shown in FIG. 3. The other arms 23 of the H shaped dog 22 are slid into a corresponding recess 25 in one of the lobes 26 of the heart-shaped blocking body 10.

Figure 8:
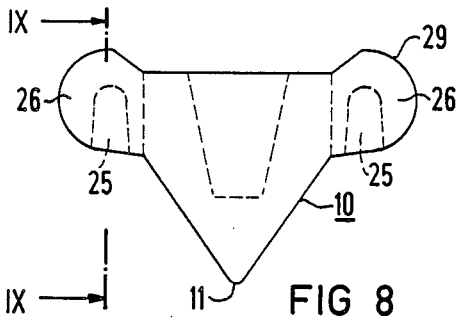
FIG. 8 illustrates a side view of a heart-shaped blocking body of the locking arrangement of FIG. 3.
Figure 9:
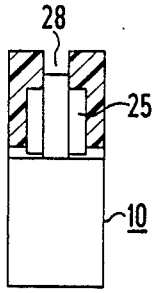
FIG. 9 provides a representation in cross section through the heart-shaped blocking body of FIG. 8 along line IX—IX.
Figure 10:
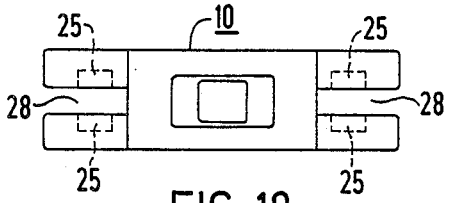
FIG. 10 illustrates a top view onto the blocking body of FIG. 8.
Figure 11:
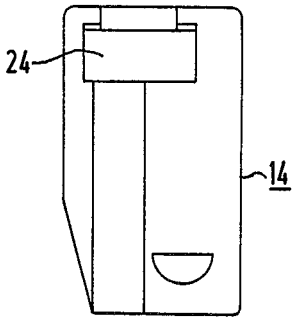
FIGS. 11, 12 and 13 illustrate a side view, front view, and top view respectively of the tappet of FIG. 3.
Figure 12:
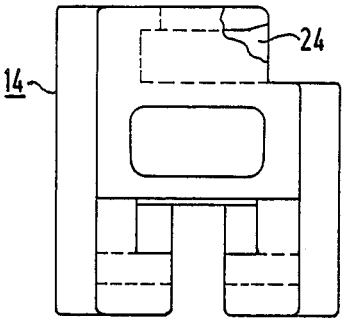
Figure 13:
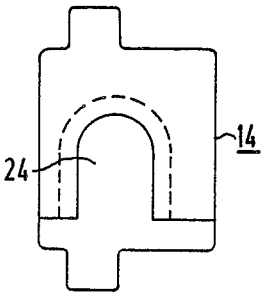

The heart-shaped blocking body 10 is shown in side view, top view and cross-section in FIGS. 8, 10 and 9 respectively. It is clear that the blocking body 10 includes two lobes 26. Furthermore, as illustrated in FIG. 9 a recess 25 is formed in each lobe 26. Also a slit 28 is formed in the lobes 26 where the slit 28 provides an opening along a direction of motion of the tappet 14 associated with that lobe. Specifically, a web 27 of the H-shaped dog 22 can be brought through slit 28 in the lobe of the heart 26. The connection of the tappets 14, H-shaped dogs 22 and lobes 26 takes place in such manner that the tappets 14 glide on a curve surface 29 of the lobes 26 upon motion of the heart-shaped blocking body 10. The gliding takes place more or less in both directions of motion of tappet 14. Through this positive connection of slide 13, with the tappet 14 via the collar screw 17, and tappet 14 with blocking body 10 via the H-shaped dogs 22, the heart-shaped blocking body is pulled back into the center position without the need of an additional spring as was required for the locking arrangement of the German utility Patent 1902103 described above.

If the slides 13 are displaced away from the mounting surface 2 by the projections 9 when the arrangement is placed between the two contactors 3 and 4, then the tip 11 of the heart-shaped blocking body 10 is pulled off the blocking curve 12. As a result the heads of the collar screws 17 penetrate through the activation holes 21 of the guide housing 8 and project from the guide housing. The length of the collar screws 17 is selected so that after the collar screws 17 are screwed into the lateral portion 16 in the direction of the mounting surface 2 of the locking arrangement until the surface of the head of the collar screws 17 is flush with the surface of the guide housing 8, the predetermined position of the heart-shaped blocking body 10 with respect to the blocking curve 12 is obtained.

What we claim is:

1. A locking arrangement for two switchgears which each include means for activating said switchgears being coupled via a blocking body in such a way that upon activation of one switchgear the activation of the other switchgear, which acts upon the blocking body in a sense opposite to that of the one switchgear is blocked, said locking arrangement comprising:

a guide housing separate from the switchgears and fastenable there between;

said blocking body comprising an essentially heart-shaped blocking body, said blocking body including a tip and a pair of lobes;

said blocking body being guided with the tip of the blocking body in said guide housing separate from the switchgears; and means for providing interaction between said lobes of the heart-shaped blocking body and said means for activating, wherein said means for providing interaction comprises, a pair of slides guided in the guide housing, one slide associated with each of said lobes, two tappets, one associated with each lobe of said blocking body, a plurality of dogs, each dog rigidly connecting a lobe with its associated tappet in the direction of motion, and means for adjustably coupling each of said slides with one of said two tappets wherein said means for adjustably coupling comprises a collar screw including a collar wherein said collar screw is in a screw connection with said slide and wherein said collar is rigidly connected to one of said tappets in a direction of motion of the slide.

2. The locking arrangement of claim 1, further comprising projections connected to each of said slides for positively coupling said slides to the activation means of the switchgears.

3. The locking arrangement as stated in claim 1 wherein said dogs are H-shaped and further wherein said tappets and said blocking body include fitted recesses transverse to said direction of motion and wherein said plurality of dogs are inserted into said fitted recesses.

4. The locking arrangement of claim 1 further comprising length-adjustable feet disposed on the guide housing.

5. The locking arrangement of claim 4 further comprising a toothing strip disposed on said guide housing and teeth disposed on said length adjustable feet wherein said length adjustable feet can be set into position with respect to said toothing strip of the guide housing before fastening to the mounting plate.

6. The locking arrangement of claim 4, further comprising a trapezoidal portion formed on the guide housing wherein said feet include a C-shaped portion for encompassing said trapezoidal portion formed-on the guide housing.

7. The locking arrangement of claim 1 wherein a head surface of the collar screws is of such length that at a given position of the blocking body said head is flush with a surface of the guide housing.

* * * * *